United States Patent [19]

Nakamura et al.

[11] Patent Number: 4,545,350

[45] Date of Patent: Oct. 8, 1985

[54] FUEL CONTROLLER OF VARIABLE CHOKE CARBURETOR

[75] Inventors: Norihiko Nakamura; Takashi Kato, both of Mishima, Japan

[73] Assignee: Toyota Jidosha Kabushiki Kaisha, Toyota, Japan

[21] Appl. No.: 665,505

[22] Filed: Oct. 30, 1984

Related U.S. Application Data

[63] Continuation of Ser. No. 437,476, Oct. 28, 1982, abandoned.

[30] Foreign Application Priority Data

Dec. 15, 1981 [JP] Japan ..... 56-201005

[51] Int. Cl.[4] ..... F02M 23/04; F02N 7/00; F02B 75/10

[52] U.S. Cl. ..... 123/439; 123/493; 123/585; 123/463; 261/DIG. 56; 261/DIG. 50

[58] Field of Search ..... 123/439, 438, 440, 493, 123/585, 463; 261/DIG. 56, DIG. 64, DIG. 67, DIG. 74, 44 D, 69 R, 121 A, 79 R, 64 A

[56] References Cited

U.S. PATENT DOCUMENTS

| | | | |
|---|---|---|---|
| 4,083,338 | 4/1978 | Berthing et al. | 123/439 |
| 4,314,535 | 2/1982 | Takeuchi et al. | 123/439 |
| 4,369,749 | 1/1983 | Sugi | 123/439 |

*Primary Examiner*—Raymond A. Nelli
*Attorney, Agent, or Firm*—Finnegan, Henderson, Farabow, Garrett & Dunner

[57] ABSTRACT

A fuel controller has a fuel cut-off device in the form of a solenoid valve connected to an intermediate part of an air bleed commmunicating with the well of a variable choke carburetor. The fuel controller also employs a vacuum changeover valve which communicates with the engine intake manifold through a passage way and is connected to the air bleed between the solenoid valve and an air jet upstream of the solenoid valve. The solenoid valve is opened when the engine is decelerating in order to allow the well and the air bleed to communicate with each other, thereby controlling the air-fuel ratio. When the key switch is IC, the air bleed and the vacuum changeover valve communicate with the well, thereby cutting the supply of fuel to the mixing chamber.

5 Claims, 4 Drawing Figures

FUEL CONTROLLER OF VARIABLE CHOKE CARBURETOR

This application is a continuation of application Ser. No. 437,476, filed Oct. 28, 1982, now abandoned.

BACKGROUND OF THE INVENTION

1. Field of the Invention

The present invention relates to the technical field of controlling the amount of fuel to be delivered during deceleration or when a key switch is turned off, by providing a vacuum control valve to a fuel cut-off device connecting with the well of a variable choke carburetor having a variable venturi diameter.

2. Description of the Prior Art

As well known, various types of carburetors for automobile engines have been devised and employed. Among them, variable choke or variable venturi carburetors have recently been mounted on a wide range of automobiles ranging from certain types of sport cars to ordinary automobiles because they provide an excellent transient response, are small in height, etc. A typical variable choke carburetor is provided with a fuel cut-off device in order to prevent "run-on" which is the condition where the engine continues to run when the ignition switch is turned off.

There are, however, various problems to be solved in a variable choke carburetor provided with a fuel cut-off device.

One of the problems is that if a run-on preventing fuel cut-off device is employed in order to prevent overheating of a catalyst, after-burning or the like while decelerating, the engine may stall when the clutch is disengaged when decelerating and moreover, discontinuous combustion may occur when the operation changes from deceleration to acceleration or to a normal operating condition.

In a conventional device, a fuel controller 2 provided for a variable choke carburetor 1 has a fuel cut-off device 3 as shown in FIG. 1. When a key switch 4 is turned IC and the engine is idling, a controller 5 detects the rotational speed indicated by a tachometer 6. When the rotational speed goes below a set value the controller 5 actuates a solenoid valve 7 to project its plunger so as to shut off an air bleed 9 which has an air jet 8 at one end and a well 10 at the other.

As is known, the air-fuel ratio when idling is determined by means of fuel 12 ejected after being sucked by a vacuum from a float chamber 11 through a fuel passage 13 and which is metered through the clearance between a metering needle 15, integrally secured to and extending from the head of a suction piston 14, and a metering jet 16 in the well 10.

When decelerating from a normal operating state, when an idling switch 17 is turned IC and the controller 5 detects a rotational speed above the set value, the solenoid valve 7 is turned IC so as to retreat, allowing the air bleed 9 and the well 10 to communicate with each other, thereby controlling the amount of the fuel 12 to be ejected.

However, this decelerating condition and the state in which the key switch 4 and the solenoid valve 7 are turned IC are the same. Moreover, since the diameter of the air jet 8 has been set for an optimum air-fuel ratio, a large amount of air is bled off under the low vacuum resulting when the key switch 4 is off, so that the fuel 12 is reduced to prevent run-on but in the decelerating condition described above, the fuel is reduced mainly in a region in which there is a small amount of intake air. Consequently, the engine may stall when the clutch is disengaged under this condition.

SUMMARY OF THE INVENTION

It is, therefore, a first object of the present invention to solve the above-mentioned problems of an excessively lean air-fuel ratio while decelerating, caused by a fuel controller having a fuel cut-off device in the conventional variable choke carburetor.

A second object of the present invention is to avoid an excessively lean mixture by setting the air jet so as to produce a required air-fuel ratio when decelerating.

Moreover, a third object of the present invention is to provide a novel variable choke carburetor fuel controller adapted to allow the different air-fuel ratios required during deceleration and when the key switch is IC to coexist with each other, by providing a vacuum changeover valve communicating with an intake manifold between the air jet and the solenoid valve, thereby permitting air to be bled from the air jet during deceleration while atmospheric air is introduced through the vacuum changeover valve when the key switch is IC.

Additional objects and advantages of the invention will be set forth in part in the descriptin which follows, and in part will be obvious from the description, or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENT

Figure 1:
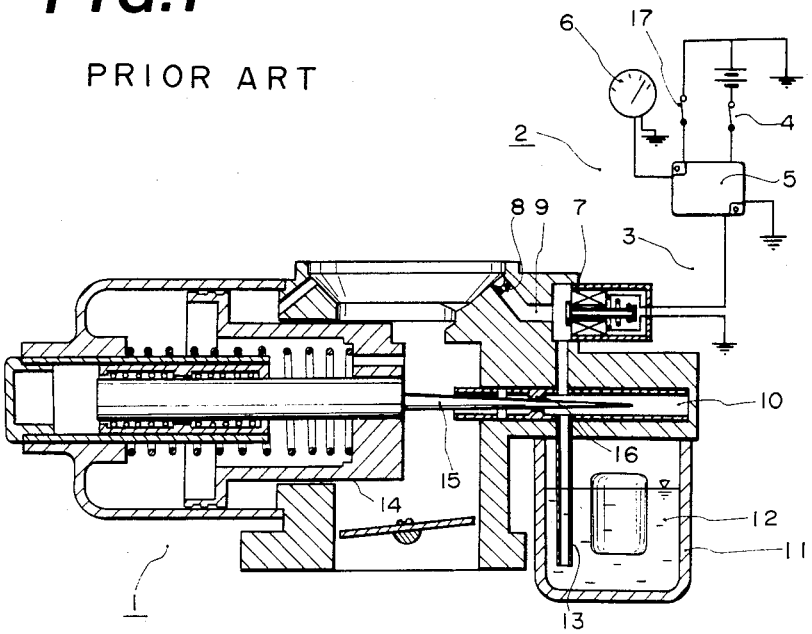
FIG.1 PRIOR ART
FIG. 1 is a cross-sectional view of a variable choke carburetor provided with a fuel cut-off device in accordance with prior art.
Figure 2:
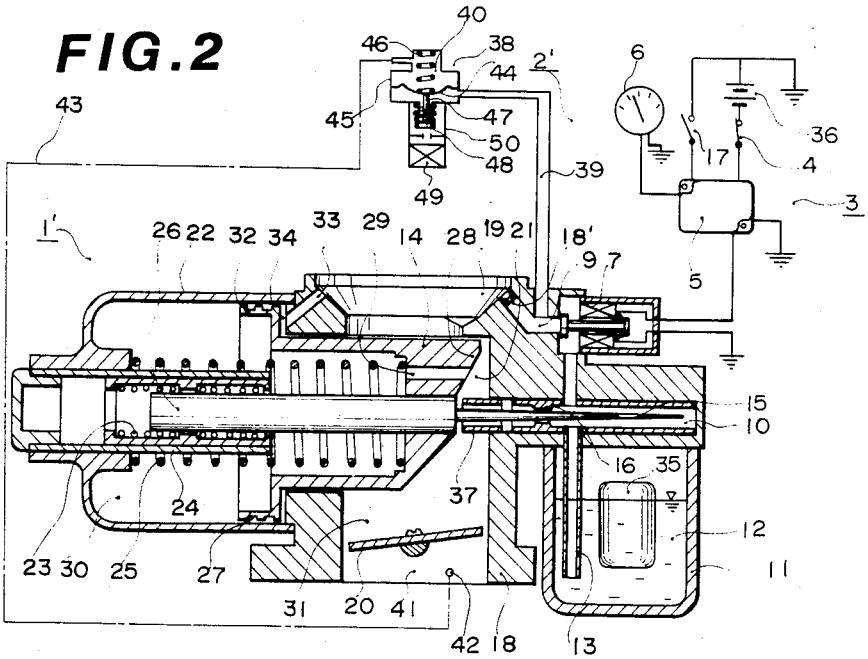
FIG. 2 is a cross-sectional view of a variable choke carburetor provided with a fuel cut-off device constructed in accordance with a preferred embodiment of the present invention.

A preferred embodiment of the present invention will be described hereinunder with reference to the accompanying drawings, particularly FIGS. 3 and 4. The description uses the same symbols for the same parts in FIGS. 3 and 4 as those in FIG. 1.

A fuel controller 2', which constitutes the subject of the present invention, is provided for a variable choke carburetor 1'.

An air horn 19 is provided on the upstream side of the barrel 18 of the variable choke carburetor 1', while a throttle valve 20 is provided on the downstream side therefrom. A suction chamber 22 is provided in one side of a venturi 21 formed therebetween. A suction piston 14 is slidably inserted into the suction chamber 22, and a rod 26 is inserted into a rod guide 24 having bearings 23. A damper spring 25 is provided between the base of chamber 22 and the inside of piston 14, as shown. The suction chamber 22 and the suction piston 14 are sealed by means of a labyrinth seal 27 formed on flange 32.

The vacuum in a mixing chamber 31 is transmitted to a vacuum chamber 30 formed in the suction chamber 22 through a suction hole 29 bored in the head 28 of the suction piston 14. An atmospheric chamber 34 is formed through a passage 33 from the air horn 19.

A float chamber 11 having a float 35 is provided on the other side of the venturi 21. A fuel passage 13 is connected to a well 10, and a metering needle 15 integrally formed with the head 28 of the suction piston 14 and extending forward from head 28 is received by a metering jet 16 provided in the well 10. Well 10 is also connected with one end of an air bleed 9 the other end of which has an air jet 18' opening into the air horn 19.

A fuel cut-off device 3 has a solenoid valve 7 which is provided in an intermediate part of the air bleed 9. Solenoid valve 7 is connected to a controller 5 which has a power source 36, a key switch 4, and an idling switch 17 which is adapted to be turned IC when decelerating, and a tachometer 6. Controller 5 is connected to the solenoid valve 7 so that the air bleed 9 and the well 10 are shut off from each other by the solenoid valve 7 under a given condition, thereby allowing the fuel 12 to be measured through the clearance between the metering needle 15 and the metering jet 16 and ejected from a main nozzle 37.

The arrangement described above is basically the same as a conventional one such as shown in FIG. 1.

In the present invention, a diaphragm unit 38 used as a vacuum changeover valve is provided, via a by-pass passage 39, between the fuel cut-off device 3 disposed in an intermediate part of the air bleed 9 and the air jet 18' disposed on the upstream side therefrom.

The diaphragm unit 38 has a vacuum chamber 40 communicating, via a passage 43, with a port 42 opening into an intake manifold 41 integrally connected to the barrel 18. A compression spring 46 is loaded in the vacuum chamber 40 formed between a diaphragm 44 and a casing 45, while a rod 47 projecting from the opposite side thereof is provided with a valve 48 so as to enable an air passage 50 fitted with an air filter 49 to be opened and closed, thereby allowing the well 10 and the air passage 50 to communicate with each other through the by-pass passage 39.

In the arrangement described above, when the key switch 4 is turned IC to turn on the engine and the throttle valve 20 is controlled so as be open by an amount corresponding to the operating conditions of the engine, the vacuum in the mixing chamber 31 due to the opening of the throttle valve 20 causes a vacuum to be formed in the suction chamber 22 through the suction hole 29. This vacuum as well as the atmospheric pressure in the atmospheric chamber 34 and the compression force of the damper spring 25 balances the suction piston 14 so that it advances or retreats according to the amount of intake air so as to open or close the venturi 21 in order to keep the vacuum in the venturi 21 constant. Consequently, the fuel 12 in the float chamber 11 is sucked into the well 10 through the fuel passage 13 and metered through the clearance formed between the metering jet 16 and the metering needle 15 before being ejected from the main nozzle 37.

When the engine is in a normal operating state, including idling, the air bleed 9 is shut off from the well 10 by actuating the solenoid valve 7 to move it plunger forward. This occurs when the controller 5 detects a rotational speed below a set value through the tachometer 6, or when the idling switch 17 is turned IC as shown in the figure. Accordingly, the air-fuel ratio is determined by means of the fuel 12 delivered through the clearance between the metering jet 16 and the metering needle 15.

Figure 3:
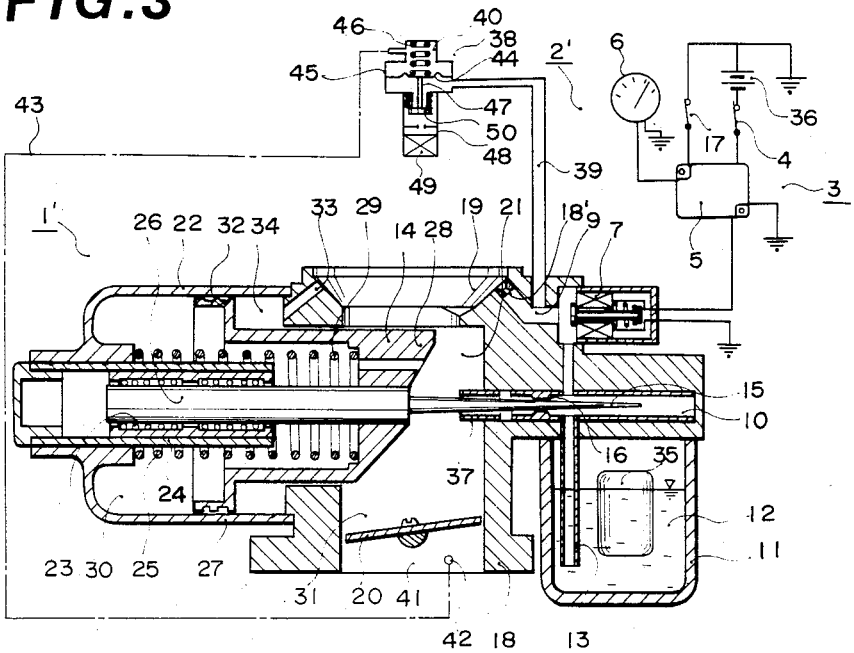
FIG. 3 is a cross-sectional view of the variable choke carburetor in accordance with the preferred embodiment of the present invention shown in FIG. 2, in particular illustrating the variable choke carburetor while decelerating.

When the throttle valve 20 is returned in order to decelerate the engine from its normal operating state, as shown in FIG. 3, the idling switch 17 is turned IC, and when the controller detects a rotational speed above the value set through the tachometer 6, it stops the current to the solenoid valve 7 so that its plunger is restored to its initial position.

Thereupon, the well 10 and the air bleed 9 are linked to each other, but the vacuum in the intake manifold 41 causes a vacuum to be formed in the vacuum chamber 40 in the diaphragm unit 38 via the port 42 and the passage 43. Consequently, the diaphragm 44 retreats against the force of the compression spring 46, so that the valve 48 of the rod 47 closes the air passage 50 and causes it and the air bleed 9 to be shut off from each other.

Accordingly, the amount of fuel 12 delivered through the clearance between the metering jet 16 and the metering needle 15 can be optimized by means of the diameter of the air jet 18'. The diameter of the air jet 18' is set so that it is possible to prevent the catalyst from overheating when decelerating, and the engine stalling when the clutch is disengaged.

Figure 4:
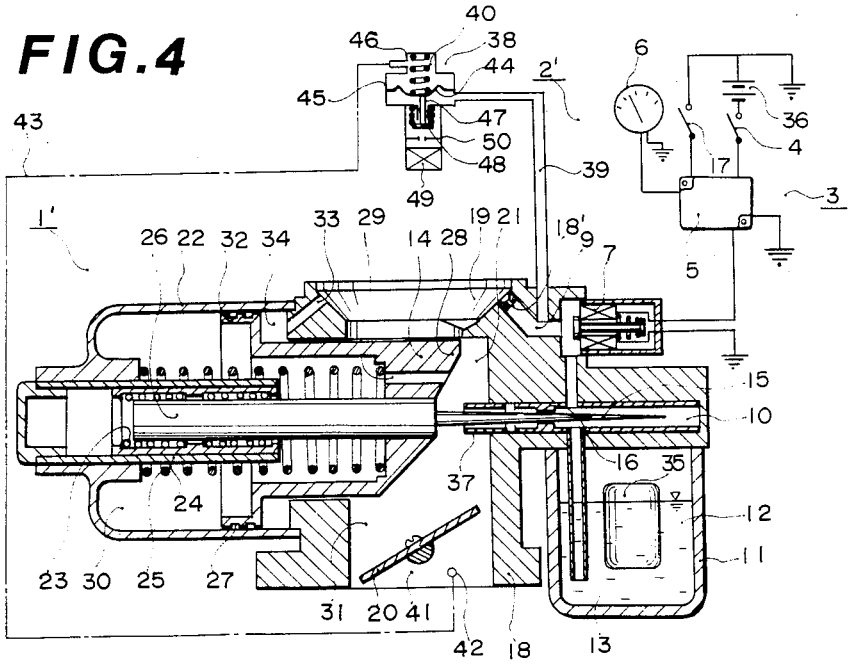
FIG. 4 is a cross-sectional view of the variable choke carburetor in accordance with the preferred embodiment of the present invention shown in FIG. 2, in particular illustrating the variable choke carburetor in the state where the key switch is IC.

When the key switch 4 is turned IC, the solenoid valve 7 is deenergized as shown in FIG. 4. Consequently, the solenoid valve 7 returns to its initial position, allowing the air bleed 9 and the well 10 to communicate with each other, and the engine speed gradually decreases until the engine stops.

In the meantime, since the vacuum in the intake manifold 41 decreases with the decrease in the engine speed, the diaphragm 44 in the diaphragm unit 38 is forced by the compression spring 46 to open the valve 48 to allow the air passage 50 and the air bleed 9 to communicate with each other through the by-pass passage 39.

Accordingly, since atmospheric air is directly introduced into the air bleed 9, even if the throttle valve 20 is open when the key switch 4 is IC, no vacuum is formed in the air bleed 9. Therefore, the fuel 12 in the float chamber 11 is not sucked up but is cut off completely, so that the engine immediately stops, thereby reliably preventing run-on.

As a result, it is possible to prevent the catalyst overheating and the engining running on during deceleration without any deterioration of the operating performance, such as stalling of the engine, discontinous combustion, etc.

The structure embodying the present invention is, needless to say, not limited to the preferred embodiment described above and a variety of structures could be employed. For instance, a solenoid-operated vacuum switching valve may be used as the changeover valve instead of the diaphragm unit, and the carburetor may be either an air-damper or oil-damper type of variable choke carburetor.

As will be fully understood from the foregoing description according to the present invention, since the vacuum changeover valve provided between the fuel cut-off device connected to an intermediate part of the air bleed communicating with the well, and the air jet provided on the upstream side therefrom, communicates with the intake manifold in the fuel controller of the variable choke carburetor, the fuel cut-off device is actuated to allow the well and the air bleed to communicate with each other when the engine is decelerating from its normal operating state where it is operating normally, but the vacuum changeover valve is shut off by means of the vacuum in the intake manifold, so that a required lean air-fuel ratio is produced by means of an appropriate amount of bleed air from the air jet, thereby preventing a too-lean mixture while decelerating. The stalling of the engine is also prevented when the clutch is disengaged, and there is no possibility of discontinous combustion when changing from deceleration to acceleration or a normal operating state. Consequently, not only overheating of the catalyst and after-burning are prevented during deceleration, but also there is an improvement in fuel comsumption. When the key switch is IC, the vacuum changeover valve communicates with the air bleed due to the reduction of the vacuum in the intake manifold, so that atmospheric air is introduced into the well through the by-pass passage, thereby completely cutting off the supply of fuel and consequently preventing run-on.

Accordingly, the excellent result is produced that a single device can simultaneously prevent the air-fuel ratio from becoming too lean during deceleration, and also prevent run-on that may occur when the key switch is turned off.

What is claimed is:

1. A fuel controller for a variable-venturi carburetor for preventing engine run-on when the ignition switch is turned off comprising:

an air-bleed passage provided between a well of said variable-venturi carburetor and an air horn;

a solenoid-operated valve connected to said air-bleed passage between said well and air horn, said solenoid-operated valve acting to open or close said air bleed passage in response to signals applied to the solenoid; and a vacuum-changeover valve in communication with said air-bleed passage between said air horn and said solenoid-operated valve, said vacuum-changeover valve being responsive to the intake manifold vacuum and controlled thereby to cut off air from said vacuum-changeover valve to said air-bleed passage during deceleration under a condition of high vacuum in the intake manifold and to introduce air from said vacuum-changeover valve into said air-bleed passage when said intake manifold vacuum is lower than a predetermined value.

2. A fuel controller for a variable-venturi carburetor as defined in claim 1, wherein the lower end of said air-bleed passageway is connected to said well, while the upper end thereof has an air jet open to the atmosphere.

3. A fuel controller for a variable-venturi carburetor as defined in claim 2, wherein the amount of bleed air from said air jet is smaller than that of the bleed air from said vacuum changeover valve.

4. A fuel controller for a variable-venturi carburetor as defined in claim 1, wherein said vacuum-changeover valve has an air passage opened and closed by valve operation so that said air passage can introduce air from said vacuum-changeover valve to said air-bleed passage when said vacuum-changeover valve is open and cut off air from said vacuum-changeover valve to said air-bleed passage when said vacuum-changeover valve is closed.

5. A fuel controller for a variable-venturi carburetor as defined in claim 1, wherein said vacuum-changeover valve includes a vacuum chamber connected to the intake manifold, a movable diaphragm defining said vacuum chamber, a diaphragm valve connected to said diaphragm and operated by movement of said diaphragm, an air passage opened and closed by said diaphragm valve in response to movement of said diaphragm, and a by-pass passage connected between said air-bleed passage and said diaphragm valve and positioned to be placed in and out of communication with said air-bleed passage when said air passage is opened and closed, respectively, by said diaphragm valve in order to introduce air to and cut off air to said air-bleed passage.

* * * * *